US012102158B2

(12) United States Patent
Chilson et al.

(10) Patent No.: US 12,102,158 B2
(45) Date of Patent: Oct. 1, 2024

(54) HELMET COUPLER AND HELMET WITH HELMET COUPLER

(71) Applicant: Tianqi Technology Co (Ningbo) Ltd, Ningbo (CN)

(72) Inventors: James A. Chilson, Ketchum, ID (US); Roger Davis, Taipei (TW)

(73) Assignee: Tianqi Technology Co (Ningbo) Ltd, Ningbo (CN)

( * ) Notice: Subject to any disclaimer, the term of this patent is extended or adjusted under 35 U.S.C. 154(b) by 189 days.

(21) Appl. No.: 17/836,939

(22) Filed: Jun. 9, 2022

(65) Prior Publication Data

US 2023/0397687 A1 Dec. 14, 2023

(51) Int. Cl.
*A42B 3/06* (2006.01)

(52) U.S. Cl.
CPC ..... *A42B 3/06* (2013.01); *A42B 3/064* (2013.01)

(58) Field of Classification Search
CPC ..... A42B 3/06; A42B 3/064; Y10T 24/3904; F16B 5/0621; F16B 21/073; F16B 5/065; F16B 19/08; F16B 2019/1009; F16B 39/105
USPC ..... 2/69
See application file for complete search history.

(56) References Cited

U.S. PATENT DOCUMENTS

| | | | | |
|---|---|---|---|---|
| 8,316,512 | B2 | 11/2012 | Halldin | |
| 9,314,061 | B2 | 4/2016 | Hanson et al. | |
| 9,750,297 | B1 | 9/2017 | Mini Townson et al. | |
| 9,907,346 | B2 | 3/2018 | Hanson et al. | |
| 9,961,952 | B2 | 5/2018 | Durocher | |
| 10,306,941 | B2 | 6/2019 | Durocher et al. | |
| 10,398,187 | B1 * | 9/2019 | Shaffer | A42B 3/064 |
| 10,477,909 | B2 | 11/2019 | Laperriere et al. | |
| 11,147,335 | B2 | 10/2021 | Pomering et al. | |
| 11,197,511 | B2 | 12/2021 | Keevy et al. | |
| 11,311,060 | B2 | 4/2022 | Ferrara | |
| 2010/0115686 | A1 | 5/2010 | Halldin | |
| 2012/0198604 | A1 | 8/2012 | Weber et al. | |
| 2013/0042397 | A1 | 2/2013 | Halldin | |
| 2014/0223641 | A1 * | 8/2014 | Henderson | A42B 3/065 2/411 |
| 2016/0073723 | A1 | 3/2016 | Halldin et al. | |
| 2017/0164678 | A1 | 6/2017 | Allen et al. | |

(Continued)

OTHER PUBLICATIONS

International Search Report and Written Opinion for PCT/IB2023/055952, mailed Sep. 4, 2023.

*Primary Examiner* — Patrick J. Lynch
(74) *Attorney, Agent, or Firm* — Klarquist Sparkman, LLP

(57) ABSTRACT

A helmet comprises an outer shell, an outer liner positioned inside of the outer shell, an inner liner positioned inside of the outer liner, at least one displacement device positioned between the inner liner and the outer liner, and at least one helmet coupler that couples at least the outer liner and the inner liner together. The coupler comprises a first head positioned in a first recess in the outer liner, and a second head positioned in a second recess in the inner liner. A coupler post extends through the outer liner and the inner liner to interconnect the first head and the second head. The displacement device produces a damped shear action in response to relative movement of the inner liner and the outer liner. The helmet coupler permits the relative movement and keeps the outer liner and the inner liner coupled together.

17 Claims, 11 Drawing Sheets

(56) References Cited

U.S. PATENT DOCUMENTS

| | | | | |
|---|---|---|---|---|
| 2018/0000186 | A1* | 1/2018 | Brown | A42B 3/064 |
| 2018/0185734 | A1 | 7/2018 | Kennard et al. | |
| 2018/0249778 | A1 | 9/2018 | Brandt et al. | |
| 2019/0297984 | A1 | 10/2019 | Krynock et al. | |
| 2019/0350298 | A1 | 11/2019 | Hoshizaki et al. | |
| 2020/0029644 | A1* | 1/2020 | Kele | A42B 3/064 |

* cited by examiner

HELMET COUPLER AND HELMET WITH HELMET COUPLER

BACKGROUND

Helmets and other protective headgear are used in many applications, including sports, construction, mining, industry, law enforcement, military and others, to reduce injury to a wearer. Potential injury to a wearer can occur by way of contact with hard and/or sharp objects, which can be reduced by a helmet that prevents such objects from directly contacting the wearer's head. In addition, non-contact injury to the wearer, such as results from linear and/or rotational accelerations of the wearer's head and can cause brain injury, can be reduced by helmets that absorb or dissipate the energy produced during impacts, including oblique impacts.

Conventional approaches permit a first component of a helmet to move or deform relative to at least a second component to absorb or dissipate the energy. The relative movement can be designed to occur between first and second components that are arranged as inner and outer components relative to each other, such as inner and outer layers.

Currently available approaches to providing a helmet construction that address both contact and non-contact injury suffer from drawbacks, including overly complex design, increased weight, high cost, difficulty in manufacture, a negative effect on proper fitting of the helmet to the wearer's head, and compromised airflow though the helmet, to name a few.

SUMMARY

Described below are embodiments of a helmet coupler and helmet having the helmet coupler that address some of the drawbacks in the prior art.

According to a first implementation, a helmet comprises an outer shell, an outer liner positioned inside of the outer shell, an inner liner positioned inside of the outer liner, and at least one helmet coupler that couples at least the outer liner and the inner liner together. The helmet coupler comprises a first head positioned in a first recess in the outer liner, wherein the first head and the first recess are curved to allow the first head to move relative to the first recess, a second head positioned in a second recess in the inner liner, wherein the second head and the second recess are curved to allow the second head to move relative to the second recess. The first recess has a first hole extending through the outer liner, and the second recess having a second hole extending through the inner liner. The coupler post extends through the first hole and the second hole and interconnects the first head and the second head. At least one displacement device is positioned between the inner liner and the outer liner. The at least one displacement device has one side attached to an outer surface of the inner liner and an opposite side attached to an inner surface of the outer liner. The displacement device is configured to produce a damped shear action in response to relative movement of the inner liner and the outer liner from an oblique impact to the helmet, with the helmet coupler being configured to permit the relative movement and keep the outer liner and the inner liner coupled together.

The coupler post can have a smaller dimension than the first hole and the second hole, thereby allowing the first head and the second head to rotate and counter rotate relative to the first recess and the second recess, respectively.

The first head can comprise a first cup with a hollow interior and a curved outer surface and the second head comprises a second cup with a hollow interior and a curved outer surface.

The coupler post can be attached at one end to the first head and can comprise a distal end with an enlarged end portion. The second head can comprise an opening through which the enlarged end portion of the coupler post can be inserted to assemble the coupler together. The opening in the second head can comprise a modified cross shape.

The first recess can have a radius of curvature that is larger than a radius of curvature of the first head and/or the second recess has a radius of curvature that is larger than a radius of curvature of the second head.

The coupler post, the first hole and the second hole can be dimensioned to permit relative translation of 5 mm to 8 mm between the inner liner and the outer liner while coupled together.

The coupler post can extend from the first head, and the second head can have a through opening shaped to receive the post, and wherein a selected length of the post that separates the first head from the second head when assembled can be adjusted by engaging a selected one of a series of engagement features on the post with a retainer on the second head.

In some implementations, the first head does not protrude from the first recess and/or the second head does not protrude from the second recess.

In some implementations, the at least one helmet coupler comprises at least first and second helmet layer couplers that are spaced apart from each other. In some implementations, the at least one helmet coupler comprises first, second, third and fourth helmet couplers that are spaced apart from each other.

The coupler post can be configured to be telescopically collapsible under a predetermined axial load.

The displacement device(s) can comprise at least one of a silicone gel sheet material, a thermoplastic urethane (TPU) material or viscoelastic material. The displacement device(s) can be configured to produce the damped shear action that exhibits progressively greater force in shear without high rebound.

The helmet can comprise at least one comfort pad coupled to an inner surface of the inner liner, wherein the at least one comfort pad is compressible to adapt the helmet to fit to a wearer's head.

According to another implementation, a helmet comprises an outer shell, an outer liner positioned inside of the outer shell, an inner liner positioned inside of the outer liner, and at least one displacement device positioned between the inner liner and the outer liner. The at least one displacement device has one side attached to an outer surface of the inner liner and an opposite side attached to an inner surface of the outer liner. The displacement device is configured to produce a damped shear action in response to relative movement of the inner liner and the outer liner from an oblique impact to the helmet. The helmet also comprises at least one helmet coupler that couples at least the outer liner and the inner liner together. The coupler comprises a first head positioned in a first recess in the outer liner, wherein the first head and the first recess are curved to allow the first head to move relative to the first recess, a second head positioned in a second recess in the inner liner, wherein the second head and the second recess are curved to allow the second head to move relative to the second recess. The first recess has a first hole extending through the outer liner, and the second recess has a second hole extending through the inner liner.

A coupler post extends through the first hole and the second hole and interconnects the first head and the second head.

At least one of the first recess and the second recess can comprise an in-mold plate formed in the outer liner or inner liner, respectively, and a corresponding recessed area. The in-mold plate can comprise the first hole or the second hole, respectively, and the first hole and/or the second hole can have a resilient border to allow the first head or the second head, respectively, to be inserted therethrough.

The first recess can comprise a first in-mold plate formed in the outer liner and having a first recessed area with the first hole. The second recess can comprise a second in-mold plate formed in the inner liner and having a second recessed area with the second hole. The first hole in the in-mold plate in the outer liner can be resiliently formed so that the first head can be forcibly inserted therethrough, and wherein the second hole in the in-mold plate in the inner liner can be resiliently formed so that the second head can be forcibly inserted therethrough to assemble the helmet coupler together.

The first in-mold plate can be positioned adjacent an inner surface of the outer liner. The second in-mold plate can be positioned adjacent an outer surface of the inner liner.

The foregoing and other objects, features, and advantages of the invention will become more apparent from the following detailed description, which proceeds with reference to the accompanying figures.

DETAILED DESCRIPTION

Described below are implementations of a helmet with a helmet coupler that couples together (or tethers) multiple helmet components and maintains them in a predetermined relationship relative to each other in the event that one component is caused to move relative to the others, such as if the helmet contacts another object with sufficient force. In some implementations, the components that are coupled together are in a nested arrangement along a radial direction extending from the cavity in the helmet for the wearer's head, also described as a layered arrangement, with a first of the coupled layers being arranged relatively inwardly and a second layer being arranged relatively outwardly. For example, the helmet coupler in some implementations is used to couple together an outer liner and an inner liner of the helmet. Other full or partial layers, or other components, may also be present to the inside of the inner liner, to the outside of the outer liner and/or between the inner and outer liners.

Figure 1:
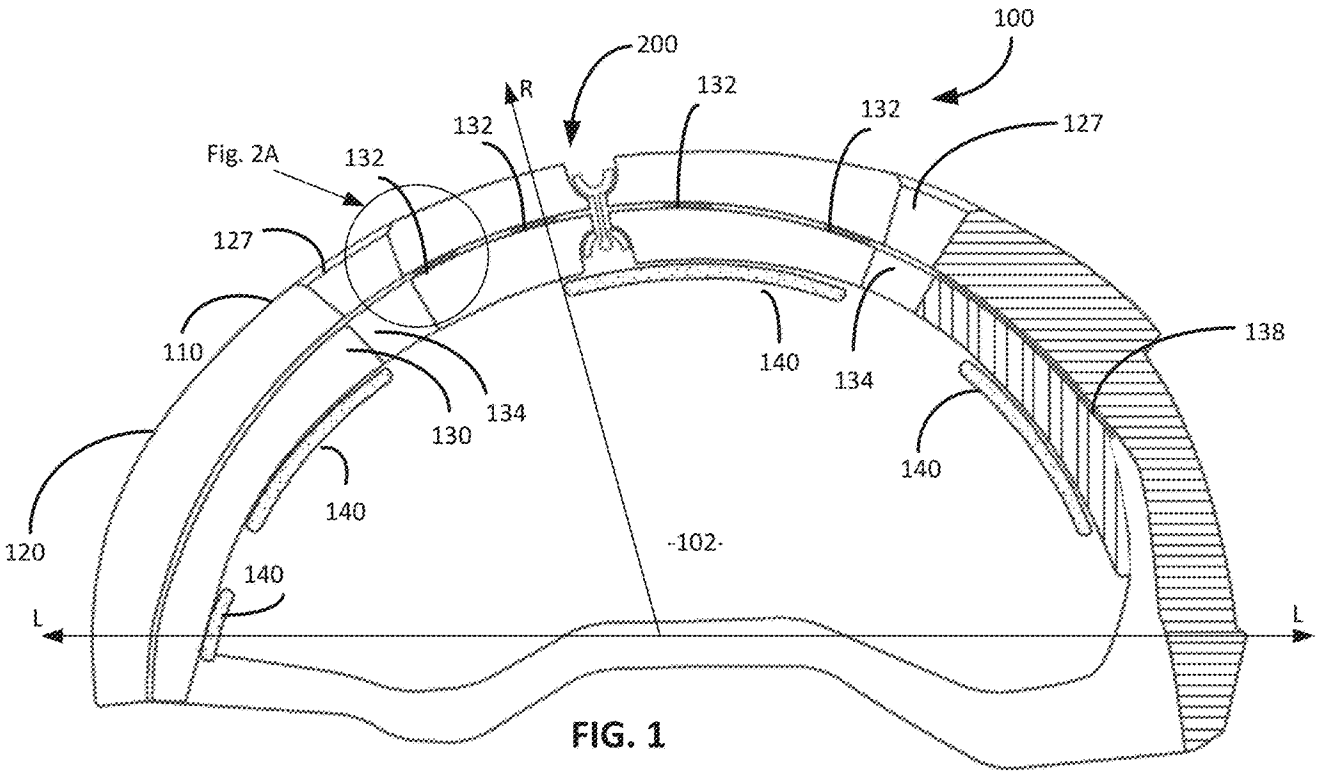
FIG. 1 is a sectioned view in elevation of a helmet having one or more helmet couplers coupling together two or more components of the helmet.

Referring to FIG. 1, a sectioned view of an exemplary helmet 100 along its longitudinal axis L shows one helmet coupler 200 (also referred to as a helmet layer coupler) visible near the crown of the helmet. The helmet coupler 200 in the illustrated implementation couples together two components of the helmet 100, namely an outer liner 120 and an inner liner 130 (also referred to herein as energy absorbing layers). In the example of FIG. 1, two components (or layers) are coupled together, but it is also possible to couple together three, four or even more components, depending upon a specific helmet's construction. Also, the components that are coupled together are typically arranged at different positions relative to each other along a radial direction R, which is defined to extend from an approximate center C of a head cavity 102 radially outwardly through the various components of the helmet. The components that are coupled together may be in contact with each other and/or spaced apart from each other.

In the illustrated implementation, one helmet coupler 200 is visible. It is possible to configure the helmet with a single helmet coupler or multiple helmet couplers. In typical applications, one, two, three, four, or even more than four helmet couplers are used, and they are arranged over the helmet, as is discussed below in more detail.

In the illustrated implementation, there are two liner components, and the two liner components are coupled together. In other implementations, there may be three or more liner or other components, and two or more of these components are coupled together. It is also possible that non-adjacent layers are coupled together, and/or that different couplers in the same helmet are used to couple together different combinations of layers. The configuration and function of the helmet coupler 200 are discussed below in detail in connection with FIGS. 3-7.

Referring again to FIG. 1, the helmet 100 also has an outer shell 110 that typically defines an outermost surface over at least a portion of the helmet. In the illustrated implementation, the outer shell 110 is formed of a plastic as the outer surface on the outer liner 120, which comprises an energy absorbing material (e.g., expanded polystyrene (EPS)). In other implementations, the outer shell 110 may be a discrete component. Optional vent openings 127, 134 are defined in the outer liner 120 and the inner liner 130, respectively. Optionally, the helmet may have one or more comfort pads 140, which may be discrete and/or interconnected components positioned on an inner surface of the helmet, to adapt the fit of the helmet to the wearer's head. Although not shown in FIG. 1 for clarity, the helmet 100 includes an adjustable helmet fit system and a chin strap for adapting the size of the helmet and securing it to the wearer's head, as escribed below in connection with FIG. 10.

The helmet 100 may be configured to permit relative movement (sometimes described as relative rotation and/or translation) between two or more components to dissipate energy in response to an oblique impact to the helmet and the wearer's head. For example, in the illustrated implementation, the helmet 100 can be configured to permit selected relative movement between the inner liner 130 and the outer liner 120 under predetermined conditions.

Figure 2A:
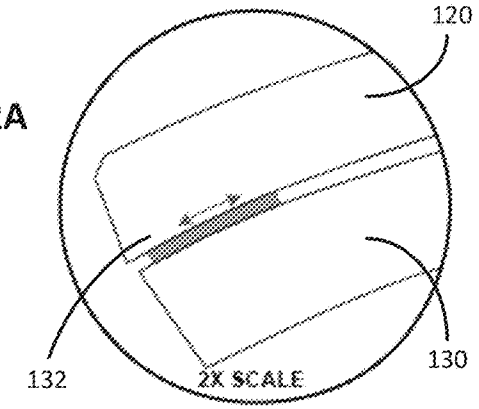
FIG. 2A is a magnified view of a portion of FIG. 1.

In the helmet 100 of FIG. 1, relative movement between the inner liner 130 and the outer liner 120 is permitted, as shown in FIG. 2A, but the resulting motion is damped shear. In the helmet 100, the inner liner 130 and the outer liner 120 are slightly spaced from each other (at least over large areas thereof) so they can rotate relative to each other without interference, but this relative motion is selectively damped by displacement devices 132 positioned at multiple locations in the space between the outer and inner liners 120, 130. In the section shown in FIG. 1, four such displacement devices 132 are visible. As examples, one or both of the facing surfaces of the inner liner 130 and the outer liner 120 can be adapted to help accomplish this function, and/or additional components may be used. Although the displacement devices 132 as illustrated are relatively smaller in size and greater in number, in some applications and/or some areas, it is possible to use larger displacement devices, such as the displacement device 138 shown at the rear of the helmet.

Figure 2B:
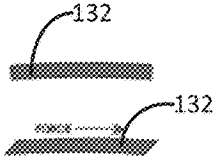
FIG. 2B is a diagram of a representative displacement device of the helmet of FIG. 1 in two different states.
Figure 3:
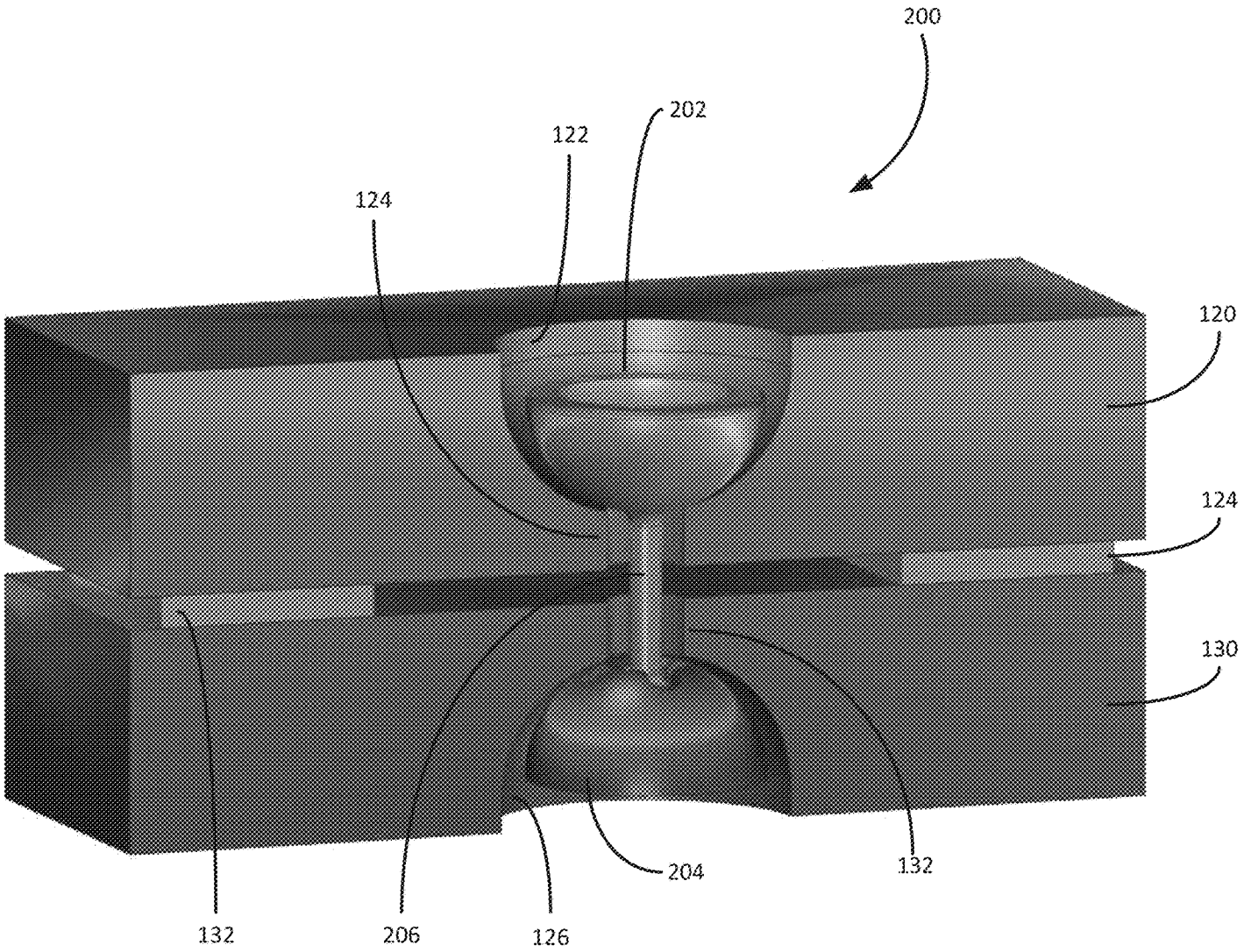
FIG. 3 is a sectioned perspective view showing the helmet coupler of FIG. 1 as assembled and coupling together portions of the outer liner and the inner liner of the helmet.

FIG. 2B shows one of the displacement devices 132 in isolation in two states: (1) an at-rest or relaxed state (upper); and (2) a deformed state when experiencing and counteracting an applied force (lower). The displacement devices 132 are formed, e.g., of a silicone gel, polyurethane or similar material. The displacement devices may be made of a shearable material such that relative movement causes shear to occur, with the shear being damped by progressively increasing resistance. The present assignee's U.S. Patent Application Publication 2021/0015195 A1, which describes representative displacement devices and their behavior in responding to an impact to the helmet, is incorporated herein by reference.

The displacement devices 132 can be affixed to facing surfaces of the inner liner 130 and the outer liner 120. In some embodiments, the displacement devices 132 comprise a silicone gel having predetermined properties selected for the application. For example, the displacement devices 132 can be pieces of silicone gel sheet material having predetermined material properties, such as a Shore 00 durometer of 0 to 60 (measured using the Shore 00 scale suited for extra soft materials). Suitable silicone gels include certain silicone gels used in medical treatment of scarred tissue. As one example, a suitable class of silicone gels is available from Wacker (SilGel family 612 and 613, https://www.wacker-.com/cms/en/products/brands_3/wacker-silgel/wacker-silgel.jsp). For example, Wacker SilGel 613 is described to have a dynamic viscosity (at 25° C.) of 150 MPa-s (uncured) and a density of 0.97 g/cm3 (at 23° C., cured and uncured). The material is described as having very low viscosity, rapid curing at room temperature, very low hardness, inherent tack and excellent damping properties. The Wacker technical data sheet for Wacker SilGel 613, Version 1.1 (date of alteration 21.05.2010) is incorporated herein by reference.

Additionally, polyurethanes having similar properties to silicone gels are also suitable materials. For example, Sorbothane® material (https://www.sorbothane.com/) is another example of a suitable class of materials. See, e.g., "Data Sheet 101 Material Properties of Sorbothane®(effective 6/1/18)," specifying tensile strength, bulk modulus, density, resilience test rebound height, dynamic Young's modulus and other physical and chemical parameters of Sorbothane® materials, which is incorporated herein by reference.

The displacement devices 132 can be dimensioned to have suitable thicknesses to maintain desired spacings between the inner liner 130 and the outer liner 120. In some implementations, the spacing is a 1.5 to 3 mm, so the displacement devices 132 can be dimensioned to have a corresponding 1.5 to 3 mm thickness as appropriate. In some implementations, the inner liner 130 is thus "suspended" within the outer liner 120 in at least some areas, depending upon the number and positions of the displacement devices 390. Further, the fit and spacing between the inner liner 130 and the outer liner 120 may provide for at least 5-8 mm of relative movement.

The displacement devices 132 may be affixed self-adhesively, and/or with an added adhesive, including, e.g., a suitable structural adhesive, pressure-sensitive adhesive or other affixing method, such as a tape (see, e.g., the products described at www.gergonne.com/en/standard-products/gergosil.html). The displacement devices 132 may be spaced apart in a pre-determined pattern over the extent of the helmet. For example, the displacement devices 132 may be positioned to cover at least 10% of the surface area.

The silicone gel and polyurethane materials as described herein are primarily implemented for use in their elastic region, i.e., such that the materials will deform during loading and then return to their original shape when the load is removed. The stress-strain curve for elastic materials, which is a progressively steepening curve, indicates that elastic materials are initially compliant and then become stiffer as the load is increased.

In some implementations, the silicone gel and polyurethane materials may exhibit viscoelastic effects. When an elastic material containing fluid is deformed, the return of the material to its original shape is delayed in time and it is slower to return to its original position. A purely elastic material behaves like an ideal spring with a linear response, and no energy loss as it is loaded and unloaded. In contrast, a viscoelastic material exhibits a time delay in returning to its original shape, and some energy is lost (or absorbed) during deformation, such as by way of heat. The viscoelastic material exhibits both viscous damping and an elastic response during deformation. The viscoelastic material is modelled by a spring (which models the elastic behavior) in series with a dashpot (which models viscosity). To the extent that displacement devices 132 absorb energy during deformation, then less energy is available to be transferred to the wearer's head, which is a benefit of such displacement devices over other types that may primarily rely on sliding surfaces.

FIGS. 3-7 are enlarged views of a portion of the helmet 100 showing details of the helmet coupler 200 according to one implementation. The coupler 200 has a first head 202, a second head 204 opposite the first head 202, and a coupler post 206 extending from the first head 202 and connected to the second head 204. The first head 202 is seated in a first recess 122 defined in the outer liner 120. The second head 204 is seated in a second recess 126 in the inner liner 130. The coupler post 206 has a distal end 208 (FIGS. 4 and 5) that is enlarged and can be forced through a coupler opening 210 (FIGS. 4 and 5) in the second head 204 to retain the assembly together. The helmet coupler 200, the first recess 122 and the second recess are dimensioned such that the helmet coupler 200 exerts either no force ("passive lock"), or a small predetermined positive force in tension ("active lock"), tending to urge the inner liner 130 and the outer liner 120 towards each other, when assembled. For example, in some implementations, the helmet coupler 200 exerts sufficient force (tension force) to keep the outer and inner liners 120, 130 in place relative to each other to reduce any play and/or noise when the helmet is in its normal condition and not experiencing any loading.

In the illustrated implementation, the first head 202 and the first recess 122, and the second head 204 and the second recess 126, respectively, have complimentary shapes to provide the desired amounts and degrees of freedom of relative movement. For example, in the illustrated implementation, the first head 202 and the second head 204 each have a curved outer surface, such as a hemispherical outer surface. Correspondingly, the first recess 122 and the second recess 126 each have a curved inner surface, such as a hemispherical inner surface. As a result, the helmet can be referred to as a "dual rotate" coupler that provides freedom of movement over at least a majority of the coupler component surfaces and is not restricted to movement in a single direction.

In the illustrated implementation, a radius of curvature $R_{122}$ (FIG. 3) of the first recess 122 can be larger than a radius of curvature $R_{202}$ of the first head 202, and a radius of curvature $R_{126}$ of the second recess 126 can be larger than the radius of curvature $R_{204}$ of the second head 204, as shown to promote free movement of the contacting surfaces relative to each other without any binding.

The curved surfaces of the first head 202, the first recess 122, the second head 204 and the second recess 126 need not be hemispherical surfaces, as more curved or less curved surfaces can also be used. Also, in some implementations, other complementary shapes that may include planar surfaces can also be used.

Figure 4:
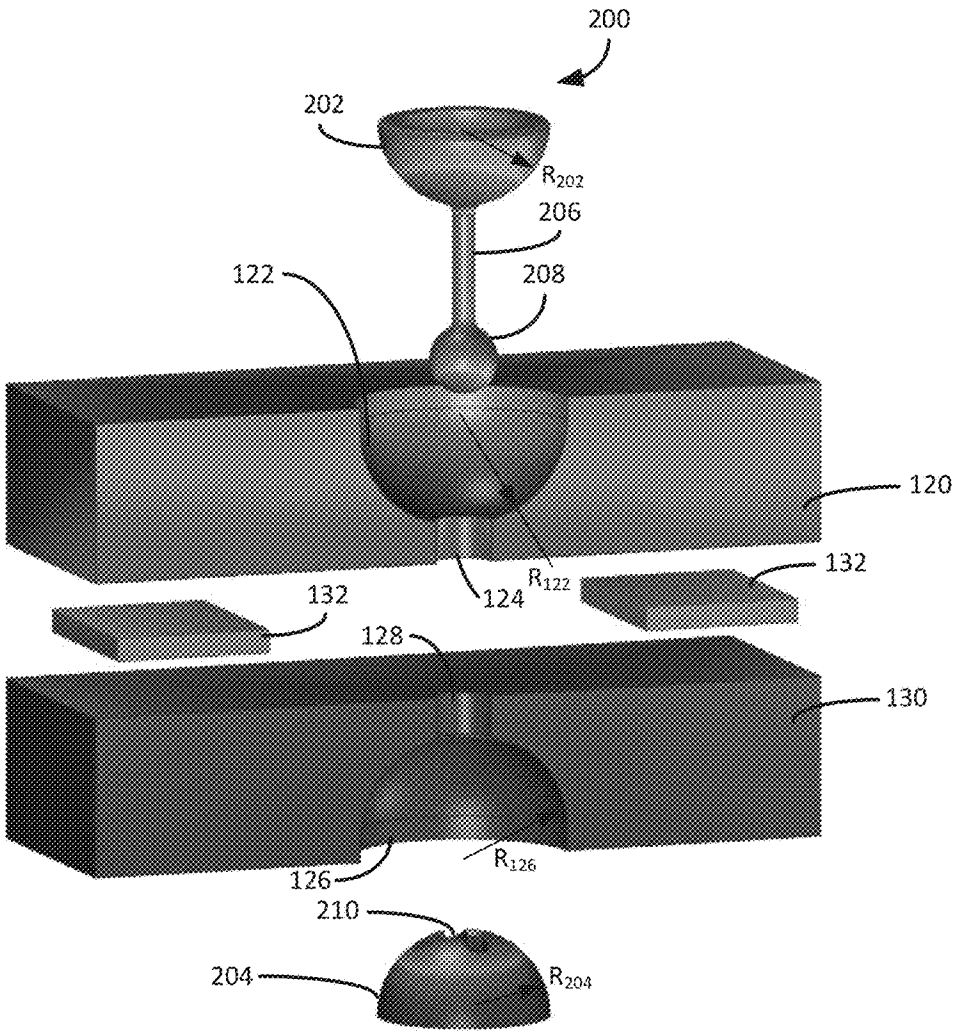
FIG. 4 is an exploded perspective view of the helmet coupler assembly of FIG. 3.
Figure 5:
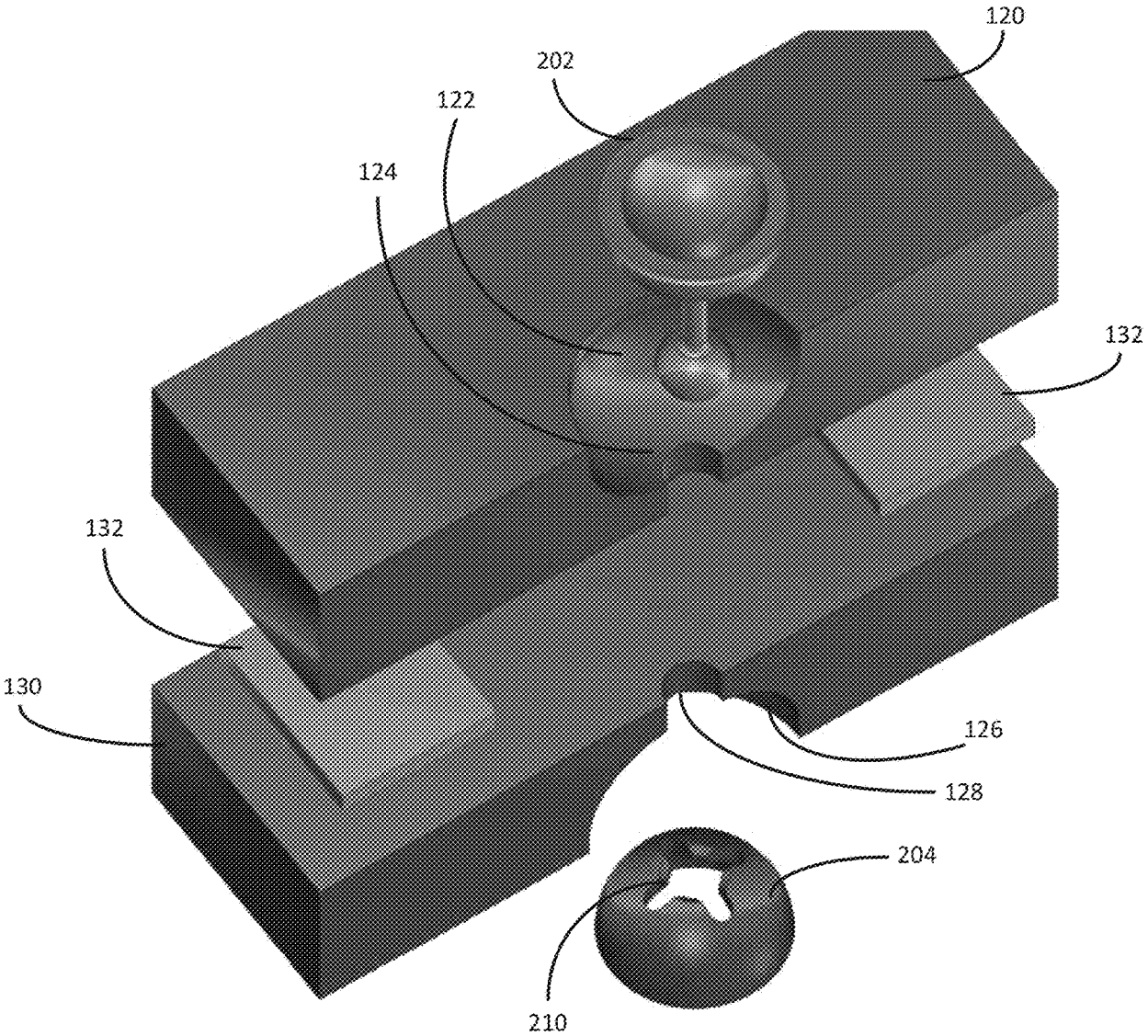
FIG. 5 is another exploded perspective view, shown from a different angle, of the helmet coupler assembly of FIG. 3.

Referring to FIGS. 4 and 5, the helmet coupler 200 can be assembled by inserting the coupler post 206 through a first hole 124 defined in the outer liner 120 at the base of the first recess 122 and a second hole 128 formed at the base of the second recess 126 in the inner liner 130. If required, the distal end 208 of the coupler post can be forced through the first and second holes 124, 128 because the materials from which the liners are made is typically resilient. The second head 204 is then aligned with the distal end 208 and urged through the opening 210, which has a smaller dimension than the distal end 208. As best seen in FIG. 5, the opening 210 in the illustrated implementation is cross-shaped.

Figure 6:
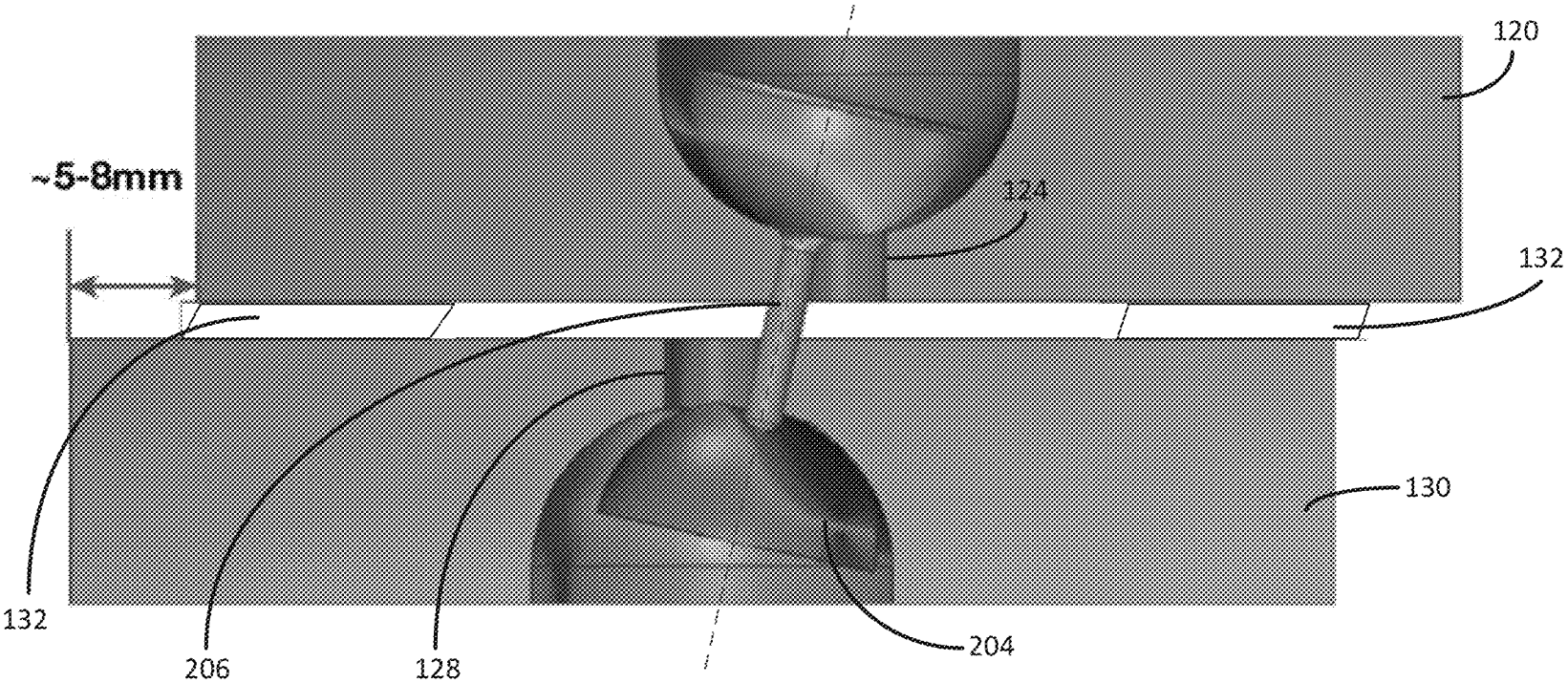
FIG. 6 is a sectioned view in elevation of the helmet coupler assembly of FIG. 3 showing how the helmet coupler has moved in response to relative displacement between the outer liner and the inner liner.

FIG. 6 shows the helmet coupler 200 at a time when relative movement of the inner liner 130 and the outer liner 120 has occurred, e.g., because of an oblique impact to the helmet. In a specific example, the inner liner 130 and the outer liner 120 have undergone a movement of approximately 5-8 mm relative to each at the illustrated location, due to a combination of torques and forces experienced throughout the helmet. As illustrated, the coupler 200 has also moved in response to the impact, without introducing resistance, while remaining connected together and continuing to couple together the inner liner 130 and the outer liner 120. Specifically, the helmet coupler 200 appears to have rotated clockwise about a point approximately midway between the first head 202 and the second head 204, with the first head 202 sliding long the first recess 122 and the second head 204 sliding along the second recess 126. At the same time, the coupler 200 has also translated, as can be seen from the coupler post 206 moving from the center of the first hole 124/second hole 128 to illustrated position where it is contacting the left side of the first hole 124 and the right side of the second hole 128. Although not shown, the helmet coupler 200 is designed to break or fail upon experiencing loading that exceeds a predetermined threshold.

Figure 7:
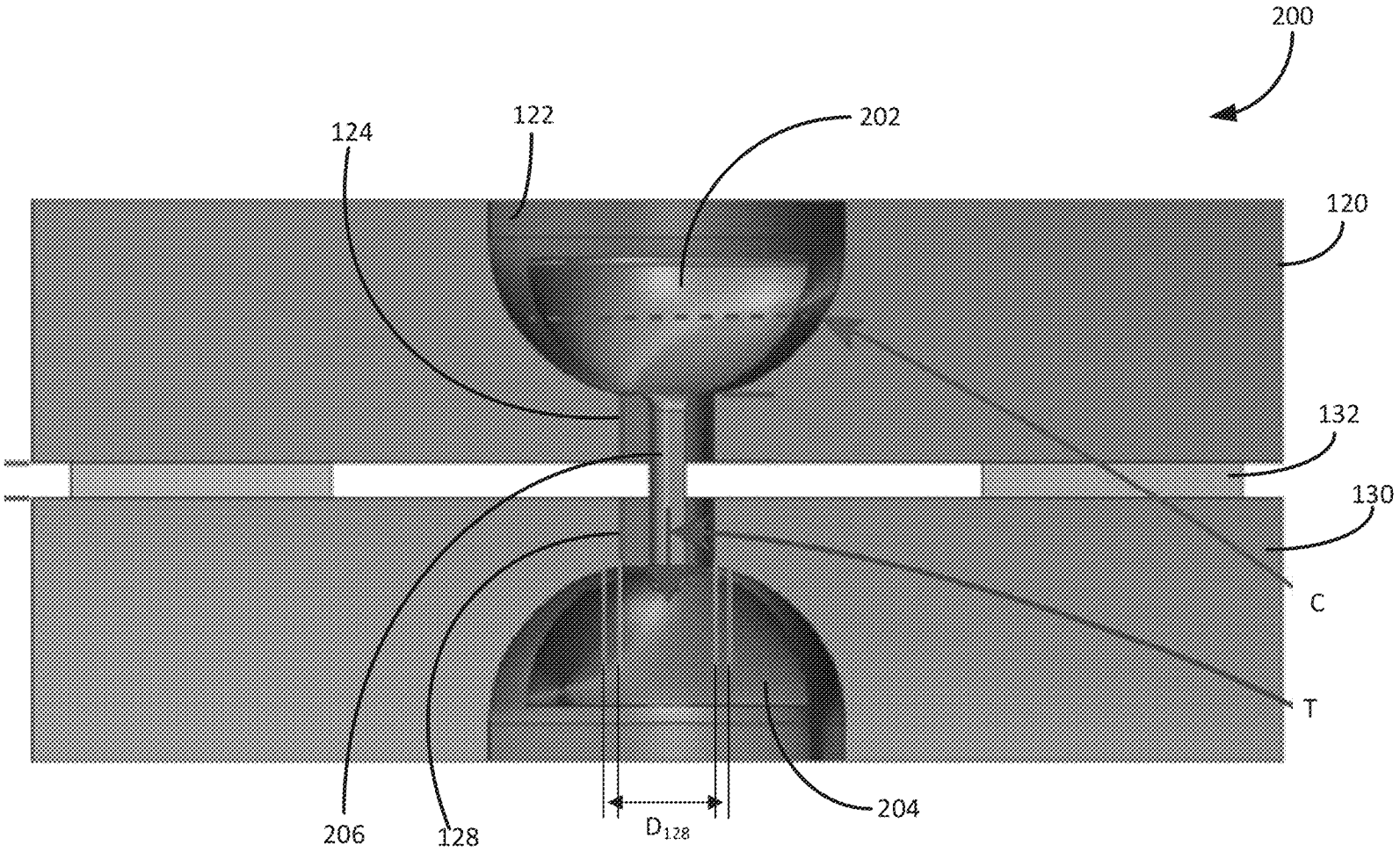
FIG. 7 is a sectioned view in elevation of the helmet coupler assembly of FIG. 3 with additional features.

Additional features of the helmet coupler 200 are shown in FIG. 7. The coupler post 206 is normally oriented in a generally radial direction and is sized and shaped to remain intact and perform the coupling function up to a desired loading. The coupler post 206 can also be configured to collapse or "telescope" in response to a direct linear force or force component of a selected magnitude experienced as an axial load (see arrow T) so as help absorb energy and not contribute to any resistance to relative movement between components. The coupler post 206 can be formed of a relatively hard material, such as a hard plastic, but can be dimensioned with a small diameter to allow it to bend and conform, which allows for more rotation of the helmet coupler 200. The first head 202 and the second head 204 can have a hollow interior, i.e., a "cup" shape as shown, or another suitable shape. A height of the first head 202 C (and/or the second head 204) can be adjusted according to the needs of the specific application, including, e.g., the thickness of the liners, as shown schematically. Also, a diameter $D_{128}$ of the second hole 128 (and/or the first hole 124) can be adjusted, e.g., to provide greater or less freedom for the helmet coupler 200 to rotate and move (see FIG. 6), as shown schematically.

Figure 9:
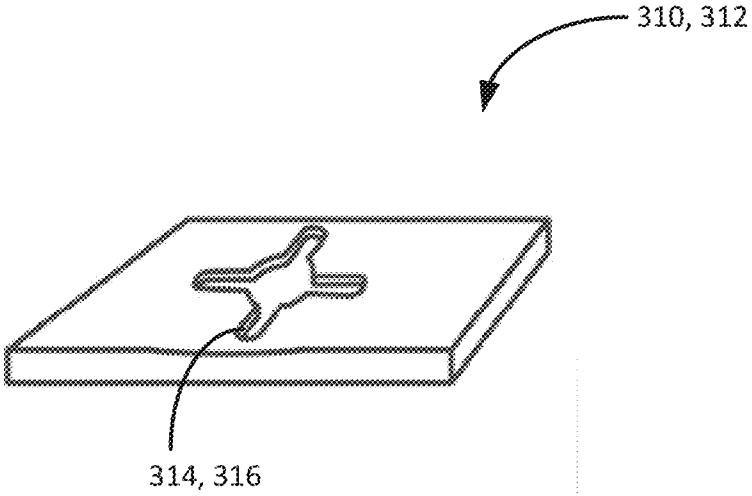
FIG. 9 is a schematic perspective view of one of the plates of FIG. 8.
Figure 8:
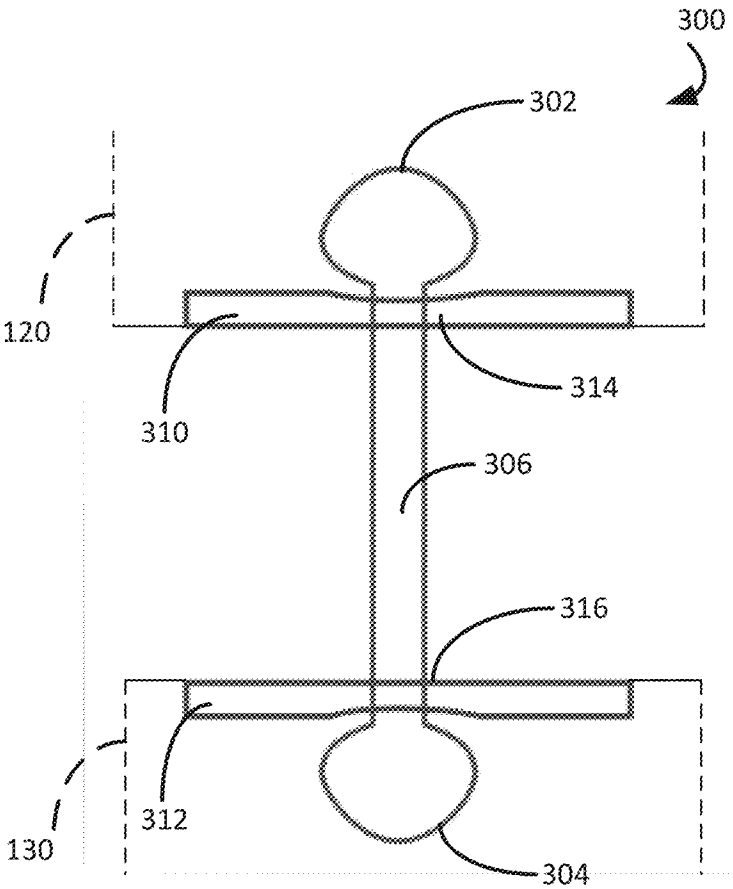
FIG. 8 is a schematic elevation view of another implementation of a helmet coupler having ends that are inserted through openings in plates, which is shown in isolation without the outer and inner liners.

FIG. 8 is a schematic view in elevation of a coupler 300 according to a second implementation. In the coupler 300, the first head 302, the second head 304 and the post (shaft) 306 connecting the first head to the second head 304 are formed as a single piece with a dog bone configuration. The first head 302 and the second head 304 have curved outer surfaces. The curved outer surface of the first head 302 contacts a first plate 310 in the area of a first opening 314, which can be slightly recessed as shown. Similarly, the curved outer surface of the second head 304 contacts a second plate 312 in the area of a second opening 316, which can be slightly recessed as shown. FIG. 9 is a perspective view of the plates 310, 312. The plates 310, 312 can be formed from plastic as in-mold plates (also called insert molded plates) in the outer liner 120 and inner liner 130, respectively. In some implementations, the in-mold components include snap baskets and anchors. In one example, the coupler 300 is assembled together by urging each head 302, 304 through the first opening 314 and the second opening 316, respectively, in a "snap-together" process. Although not shown to scale (or with the displacement devices present), the outer liner 120 and the inner liner 130 can be separated by the same 1.5 to 3 mm.

Figure 10:
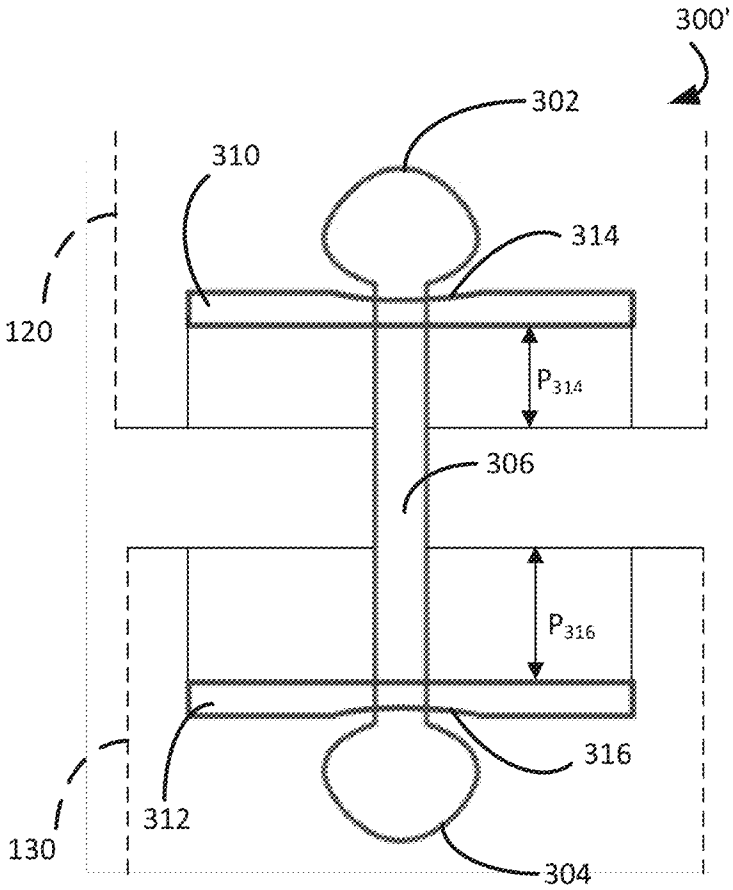
FIG. 10 is a schematic elevation view similar to FIG. 8, except showing the plates recessed within the inner and outer layers.

FIG. 10 is a schematic view in elevation of a coupler 300', which is similar to the coupler 300, except that the plate 310 and/or the plate 312 is recessed from the respective surface of the outer liner 120, inner liner 130. For example, the plate 310 can be recessed by a distance $P_{314}$ from the inner surface of the outer liner 120. Similarly, the plate 312 can be recessed by a distance $P_{316}$ from the outer surface of the inner liner 130. The distances $P_{314}$, $P_{316}$ can be equal or unequal, depending upon the application and geometry requirements. Although not shown to scale (or with the displacement devices present), the outer liner 120 and the inner liner 130 can be separated by the same 1.5 to 3 mm.

Figure 13:
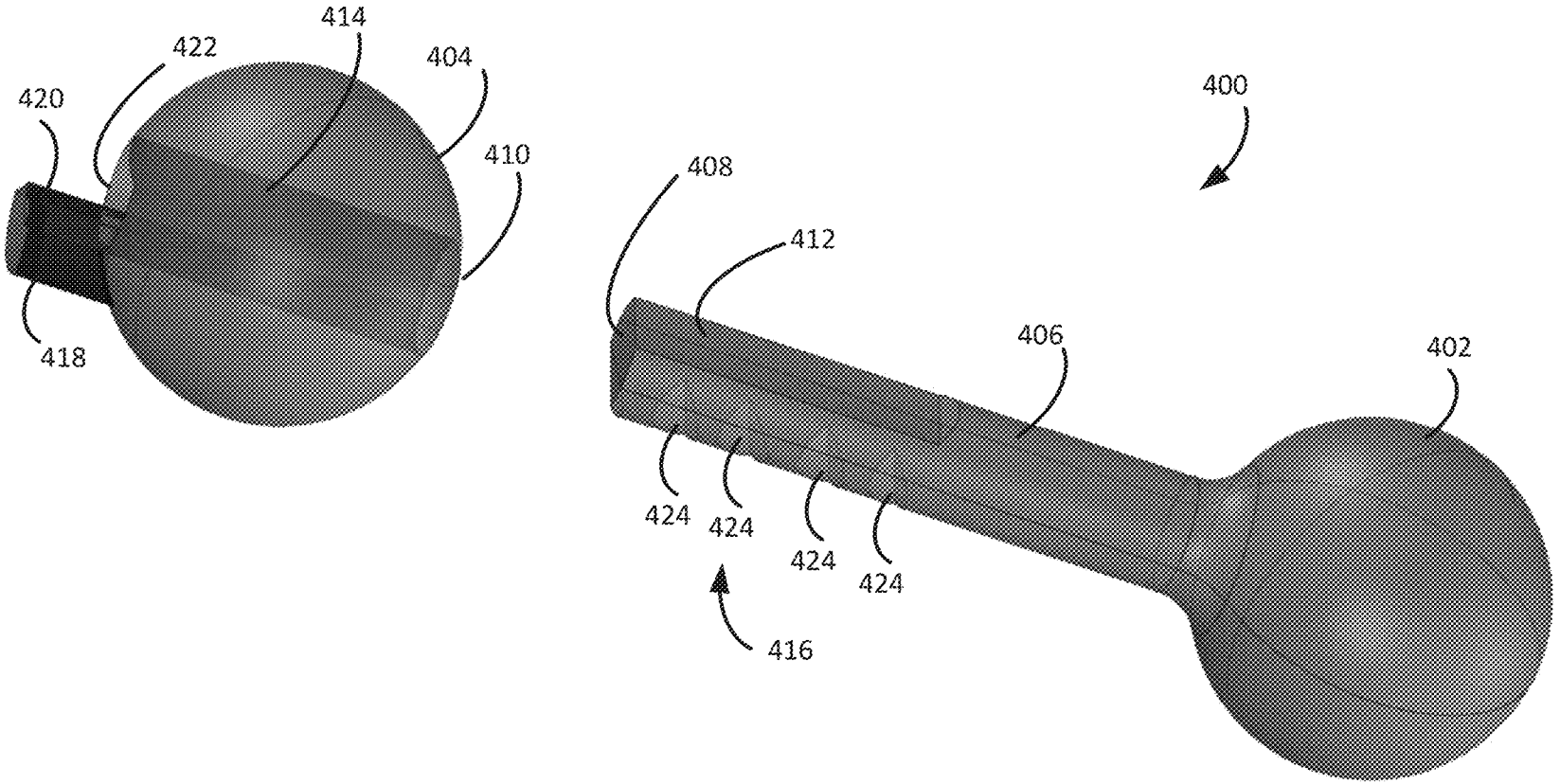
FIG. 13 is a perspective view of a helmet coupler having a selectively adjustable length.

FIG. 13 is a perspective view of a coupler 400 having a selectively adjustable length. In FIG. 13, the coupler 400 is shown in isolation with its first head 402 (or end) connected to its post (shaft) 406, and a separate second head 404 (or end) positioned in alignment the post 406 before they are assembled together. To complete assembly, the distal end 408 of the post 406 is inserted into the opening 410 in the second head 404. In the illustrated implementation, the opening 410 is a through hole, but the opening may be shaped as a recess for some applications.

The post 406 has a series of spaced engagement features 416 that allow for the length of the post in the assembled coupler 400 to be adjusted longer or shorter, such as to adapt the coupler 400 for use at different locations in the same helmet, in helmets of different sizes and/or in different helmet models. In the illustrated implementation, the engagement features 416 are axially spaced detents 424. The second head 404 has a retainer 420 shaped to engage a selected one of the detents 424, which retains the coupler 400 at a selected length sufficient for the application. The length may be selected based on the thickness of the layers between the first head 402 and the second head 404 (not shown), as well as any desired force to be exerted by the coupler 400.

In the illustrated embodiment, the retainer 420 is shaped as a projecting tip positioned to engage one of the detents 424 once the post 406 is pushed completely through the opening 410. In the illustrated implementation, the retainer 420 protrudes from an extension member 418 positioned near an exit opening 422 and extending away from the surface of the second head 404. Other engagement feature and retainer arrangements sufficient to secure the first head 402 and the second head 404 together with a desired post length can also be used.

To assist in proper assembly of the coupler 400, the post 406 and the opening 410 can have one or more alignment features. For example, in the illustrated implementation, the post 406 has an alignment flat 412, which can be positioned generally opposite the engagement features 416. The opening 410 is shaped to have an alignment flat 414 generally opposite the retainer 420. In this way, during assembly of the post 406 with the opening 410, the alignment flat 412 of the post 406 can be aligned with the alignment flat 414 of the opening 410 so that as the post 406 is inserted further, the engagement features 416 are properly aligned with the retainer 420. In addition, the alignment flats 412, 416 prevent relative rotation between the post 406 and the second head 404, thereby keeping the first head 402 and the second head 404 engaged with each other at the desired post length. Instead of, or in addition to flat surfaces, other mating and/or complimentary features can be used as alignment features.

The helmet coupler 200, 300, 400 can be made from any suitable material(s) that provides the required physical properties appropriate for the specific application. For example, the coupler may be constructed of nylon (polyamide), ABS (acetal butadiene styrene), acetal/polyoxymethylene (POM) (including, e.g., Delrin®), polycarbonate, polypropylene, HDPE (polyethylene), thermoplastic polyester (including, e.g., Hytrel®) and/or other similar materials. In general, the coupler 200, 300, 400 is made from materials that have greater strength, hardness and lower elasticity than the displacement devices 132, the outer liner 120 and the inner liner 130. The materials may be suited to injection molding.

As also described elsewhere herein, the outer liner 120 and the inner liner 130, which are also referred to as energy absorbing layers, may be formed of any suitable materials. In some implementations, the first and second energy absorbing layers are formed of an EPS (expanded polystyrene) material or a similar foamed polymer material. Other shock absorbing materials, such as expanded polypropylene (EPP), vinyl nitrile foam, thermoplastic urethane (TPU) foam and others, can also be used. In some implementations, polycarbonate can be used.

In some implementations, one or more energy absorbing layers are formed of a plastic material having a hollow geometry designed to produce reliable crush characteristics. One such material is sold under the name Koroyd® and has co-polymer extruded tubes that are thermally welded together into a core. Another such material is sold under the name Wavecel™ and is described as dual-density cellular co-polymer material formed into collapsible cells. In some implementations, such a hollow plastic material is formed using a 3D printing or other similar process. The protective outer shell is preferably formed of a hard plastic, such as polycarbonate, ABS or other suitable plastic.

Figure 11:
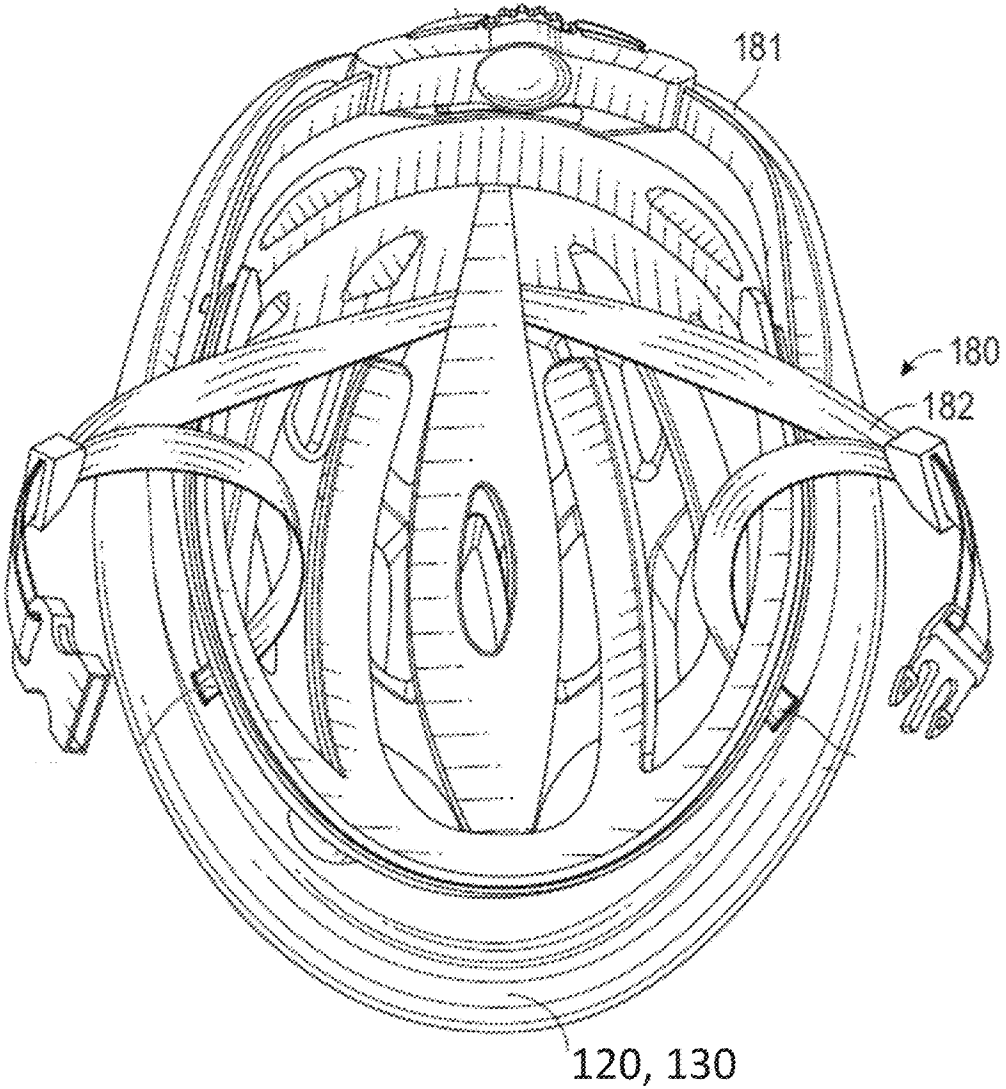
FIG. 11 is a plan view of another helmet showing a representative fit system.

FIG. 11 is a bottom plan view of another helmet in a fully assembled condition, which is included to show a typical fit system 180 for adapting the size and shape of the of the helmet to the wearer's head. The fit system 180 includes an adjustable band 181 or a portion thereof to fit the cavity of the helmet closely to the circumference of the wearer's head and one or more straps 182 to secure the helmet to the wearer's head, such as around the wearer's chin. The straps 182 are secured together by buckle parts 184.

As described, the helmet can include one or more comfort pads 140 that are dimensioned and positioned to fit the inner cavity of the helmet to the wearer's head. The comfort pads 388 may be permanently or removably attached to the inner surface of the helmet. In some implementations, the comfort pads 140 may incorporate displacement device technology in conjunction with the displacement devices 132 to assist in managing oblique impacts.

Figure 12:
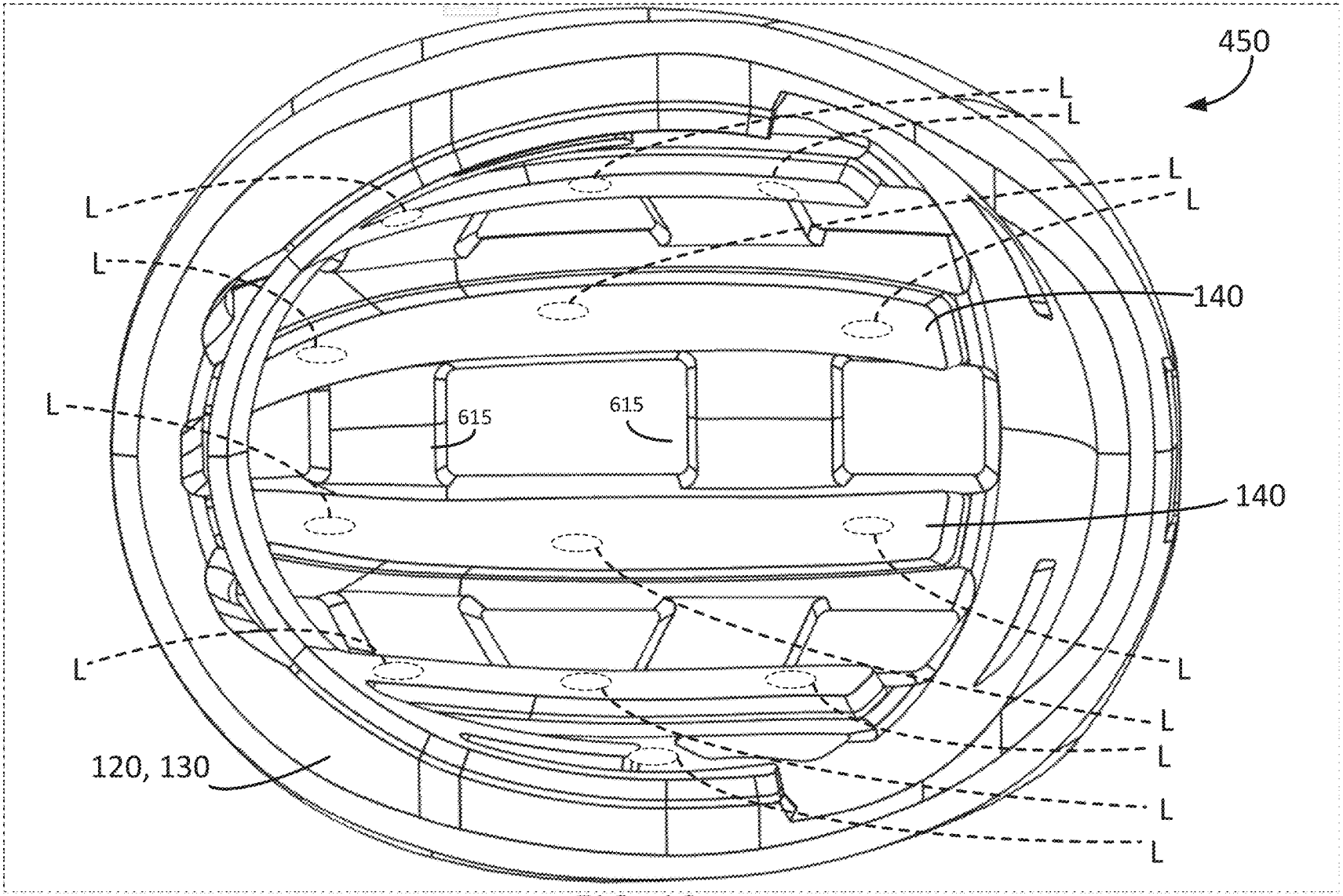
FIG. 12 is a plan view of another helmet showing representative locations for the helmet couplers.

FIG. 12 is a bottom plan view of another helmet 450, which is shown without straps for clarity, that indicates various representative locations L for the helmet coupler 200, 300, 400 throughout the interior of the helmet. In general, the locations L include any position where two or more layers, such as the outer liner 120 and the inner liner 130, are overlapped with each other. In typical implementations, one, two, three, four, five or even more couplers are used.

The illustrated helmet is a sports helmet, i.e., a cycling helmet, but the same principles can be applied to protective helmets for ice hockey, lacrosse, football, baseball, rugby, cricket, climbing, motorcycling, car racing, skiing, snowboarding, skating, skateboarding, equestrian activities and other such activities. Further, the same principles can be applied to helmets or hard hats for mine workers, builders, industrial machine operators, soldiers, law enforcement personnel and others.

In view of the many possible embodiments to which the disclosed principles may be applied, it should be recognized that the illustrated embodiments are only preferred examples and should not be taken as limiting the scope of protection. Rather, the scope of protection is defined by the following claims. We therefore claim all that comes within the scope and spirit of these claims.

We claim:

1. A helmet, comprising:

an outer shell;

an outer liner positioned inside of the outer shell;

an inner liner positioned inside of the outer liner;

and at least one helmet coupler that couples at least the outer liner and the inner liner together, the at least one helmet coupler comprising a first head positioned in a first recess in the outer liner, wherein the first head is cup-shaped and has a substantially solid outer surface that is substantially positively curved, and the first recess has a substantially solid inner surface that is substantially positively curved, and wherein the first head and the first recess are dimensioned relative to each other to allow the first head to move relative to the first recess, a second head positioned in a second recess in the inner liner, wherein the second head is cup-shaped and has a substantially solid outer surface that is substantially positively curved, and the second recess has a substantially solid inner surface that is substantially positively curved, and wherein the second head and the second recess are dimensioned relative to each other to allow the second head to move relative to the second recess, the first recess having a first hole extending through the outer liner, and the second recess having a second hole extending through the inner liner, a coupler post extending through the first hole and the second hole and interconnecting the first head and the second head, wherein the coupler post, the first hole and the second hole are dimensioned to permit relative translation between the inner liner and the outer liner from an aligned position where the first hole and the second hole are aligned with each other to a translated position where the first hole and the second hole are offset from each other to keep the inner liner and outer liner coupled together, and multiple viscoelastic pads positioned between the inner liner and the outer liner, each of the multiple viscoelastic pads having one side attached to an outer surface of the inner liner and an opposite side attached to an inner surface of the outer liner, wherein each of the multiple viscoelastic pads is configured to produce a damped shear action in response to the relative translation of the inner liner and the outer liner.

2. The helmet of claim 1, wherein the coupler post has a smaller dimension than the first hole and the second hole, thereby allowing the first head and the second head to rotate and counter rotate relative to the first recess and the second recess, respectively.

3. The helmet of claim 1, wherein the coupler post is attached at one end to the first head and comprises a distal end with an enlarged end portion, and wherein the second head comprises an opening through which the enlarged end portion of the coupler post can be inserted to assemble the helmet coupler together.

4. The helmet of claim 3, wherein the opening in the second head comprises a cross shape.

5. The helmet of claim 1, wherein the first recess has a radius of curvature that is larger than a radius of curvature of the first head and/or the second recess has a radius of curvature that is larger than a radius of curvature of the second head.

6. The helmet of claim 1, wherein the coupler post, the first hole and the second hole are dimensioned to permit relative translation of 5 mm to 8 mm between the inner liner and the outer liner while coupled together.

7. The helmet of claim 1, wherein the coupler post extends from the first head and the second head has a through opening shaped to receive the coupler post, and wherein a selected length of the coupler post that separates the first head from the second head when assembled can be adjusted by engaging a selected one of a series of engagement features on the coupler post with a retainer on the second head.

8. The helmet of claim 1, wherein the at least one helmet coupler comprises at least first and second helmet layer couplers that are spaced apart from each other.

9. The helmet of claim 1, wherein the at least one helmet coupler comprises first, second, third and fourth helmet couplers that are spaced apart from each other.

10. The helmet of claim 1, wherein the coupler post is configured to be telescopically collapsible under a predetermined axial load.

11. The helmet of claim 1, wherein the multiple viscoelastic pads comprise at least one of a silicone gel sheet material or a thermoplastic urethane (TPU) material.

12. The helmet of claim 1, wherein the multiple viscoelastic pads are configured to produce the damped shear action.

13. The helmet of claim 1, further comprising at least one comfort pad coupled to an inner surface of the inner liner, wherein the at least one comfort pad is compressible to adapt the helmet to fit to a wearer's head.

14. The helmet of claim 1, wherein the cup-shaped surface of the first head conforms at least in part to a surface of a spheroid.

15. The helmet of claim 1, wherein the cup-shaped surface of the first recess conforms at least in part to a surface of a spheroid.

16. The helmet of claim 1, wherein the cup-shaped surface of the second head conforms at least in part to a surface of a spheroid.

17. The helmet of claim 1, wherein the cup-shaped surface of the second recess conforms at least in part to a surface of a spheroid.

* * * * *